United States Patent [19]

Aharonian

[11] Patent Number: 4,915,391

[45] Date of Patent: Apr. 10, 1990

[54] BOARD GAME

[76] Inventor: Aharon G. Aharonian, P.O. Box 67, Shrewsbury, Mass. 01545

[21] Appl. No.: 284,997

[22] Filed: Dec. 15, 1988

[51] Int. Cl.[4] ..... A63F 3/00

[52] U.S. Cl. ..... 273/256; 273/291

[58] Field of Search ..... 273/256, 243, 248, 249, 273/291

[56] References Cited

U.S. PATENT DOCUMENTS

| | | | |
|---|---|---|---|
| 2,026,085 | 12/1935 | Darrow | 273/256 |
| 2,691,528 | 10/1954 | Laidlaw | 273/256 |
| 2,976,044 | 3/1961 | Corpening | 273/256 |
| 3,565,437 | 2/1971 | Mitchell | 273/256 |

*Primary Examiner*—Edward M. Coven
*Assistant Examiner*—Benjamin Layno
*Attorney, Agent, or Firm*—Wolf, Greenfield & Sacks

[57] ABSTRACT

A board game whose gameboard design is composed of an endless path of purchasable blocks representing the major national American holidays along with other common, traditional seasonal occurences, pursuits, and activities as well as certain special categories. The concept of the game is to acquire as many of the business services, and activities type blocks as one can. Each player is provided with a differently color coded player marker. Each player, in turn, moves their player marker along the path of blocks according to the roll of a standard pair of dice. Some of these blocks each display two alternative directions. When a player's marker lands on such a block, the direction to be followed is determined by rolling another die having each of its faces marked with one of the letters A and B corresponding to the alternative directions. The object of the game is to win by forcing opponents to retire from the game by mortgaging all their businesses, properties, and services along with the depletion of all their money. The last remaining player is the winner. The game also includes play money, destiny cards, ownership cards, a plurality of sets of color coded property markers placeable on the purchasable blocks for indicating ownership and a set of instructions.

6 Claims, 7 Drawing Sheets

11

11

IT'S INDEPENDENCE DAY.
YOU ILLEGALLY BOUGHT A LARGE SUPPLY OF FIREWORKS & FIRECRACKERS. PAY $ 400 FINE TO THE BANK.

© 1988 A.G. AHARONIAN
ALL RIGHTS RESERVED

COLLECT $ 500 FROM THE BANK FOR A GALA NEW YEAR'S PARTY.

© 1988 A.G. AHARONIAN
ALL RIGHTS RESERVED

THIS CARD ALLOWS YOU TO MAKE ONE "RECONSIDERED MOVE" OF YOUR MARKER ANYTIME DURING THE GAME--BY THROWING THE DICE A SECOND TIME.
RETURN CARD TO THE BOTTOM AFTER YOU HAVE MADE YOUR "RECONSIDERED MOVE."

© 1984, 1988 A.G. AHARONIAN
ALL RIGHTS RESERVED

IT IS FRIDAY THE 13TH.

YOU ARE BEING SPOOKED.

GIVE THE BANK $ 300.

© 1988 A.G. AHARONIAN
ALL RIGHTS RESERVED

YOU JUST RETURNED TO SCHOOL. YOU NEED TO PAY AN EXTRA $ 500 TUITION.

© 1988 A.G. AHARONIAN
ALL RIGHTS RESERVED

IT IS GRADUATION DAY. YOU RECEIVE $ 500 AS A GRADUATION GIFT FROM THE BANK.

© 1988 A.G. AHARONIAN
ALL RIGHTS RESERVED

ADVANCE TO TAX DAY UNIT A TAX PAYER SERVICE.
IF UNOWNED, YOU MAY BUY IT. IF ALREADY OWNED PAY ONLY HALF THE TAX DUE.

© 1988 A.G. AHARONIAN
ALL RIGHTS RESERVED

ADVANCE TO TAX DAY UNIT B TAX PAYER SERVICE.
IF UNOWNED, YOU MAY BUY IT. IF ALREADY OWNED PAY ONLY HALF THE TAX DUE.

© 1988 A.G. AHARONIAN
ALL RIGHTS RESERVED

FIG. 7

SUMMER PICNIC
CATERING BUSINESS
OWNER

| | PURCHASE PRICE | MORTGAGE VALUE |
|---|---|---|
| 1 TILE | $400 | $200 |
| 2 TILES | $800 | $400 |

CATERING COST

| | |
|---|---|
| 1 TILE | $ 300 |
| 2 TILES | $ 600 |

UNIT A

SUMMER PICNIC
CATERING BUSINESS
FANCY FOODS
HOTDOGS HAMBURGERS
PIZZAS DRINKS

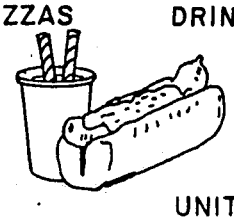

UNIT A

SUMMER PICNIC
GOURMET CATERING
OWNER

| | PURCHASE PRICE | MORTGAGE VALUE |
|---|---|---|
| 1 TILE | $ 500 | $ 250 |
| | $ 1000 | $500 |

CATERING COST

| | |
|---|---|
| 1 TILE | $400 |
| 2 TILES | $ 800 |

UNIT B

SUMMER PICNIC
GOURMET CATERING
MOUTH-WATERING
DELICIOUS GOURMET FOODS
STEAKS-LOBSTERS-OYSTERS
ROAST BEEF-SALADS-DRINKS

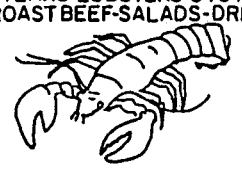

UNIT B

THANKSGIVING DAY
"LITTLE TOM"
TURKEY FARM OWNER

| | PURCHASE PRICE | MORTGAGE VALUE |
|---|---|---|
| 1 TILE | $2000 | $1000 |
| 2 TILES | $4000 | $2000 |

COST OF TURKEYS

| | |
|---|---|
| 1 TILE | $ 1500 |
| 2 TILES | $ 3000 |

UNIT A

THANKSGIVING DAY
"LITTLE TOM"
TURKEY FARM

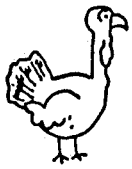

UNIT A

THANKSGIVING DAY
"BIG TOM"
TURKEY FARM OWNER

| | PURCHASE PRICE | MORTGAGE VALUE |
|---|---|---|
| 1 TILE | $2400 | $1200 |
| 2 TILES | $4800 | $2400 |

COST OF TURKEYS

| | |
|---|---|
| 1 TILE | $2000 |
| 2 TILES | $4000 |

UNIT B

THANKSGIVING DAY
"BIG TOM"
TURKEY FARM

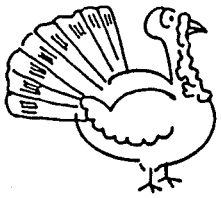

UNIT B

FIG. 8 (PART)

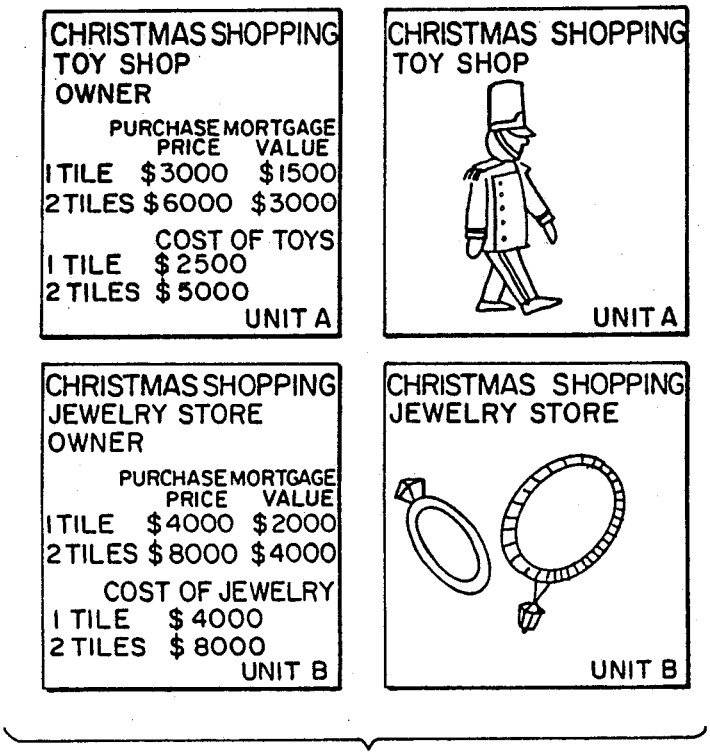
FIG. 8 (PART)
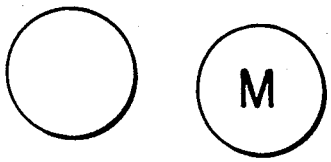
FIG. 9

BOARD GAME

BACKGROUND OF THE INVENTION

The present invention relates generally to games and more particularly to board games Board games are a well known and very popular form of entertainment for people of all ages.

In U.S. Pat. No. 4,480,838 to A. G. Aharonian there is disclosed a family financial board game entitled Born Again. The game includes a game board having two separate paths, a quantity of play money, a set of first generation cards, a set of second generation cards, a set of fate cards, a set of chromosome dice, a set of numerical dice, a plurality of tokens, each representing a player, a set of pieces, each representing a family, a plurality of markers each representing an offspring or a sibling and a plurality of property pieces. One of the paths on the game board is divided into time periods of a life cycle while the other path is employed for commercial dealings of a player's family. In playing the game, the players and their families pass through different time periods of their lives on the life cycle track while one of the family members seeks fortune for the family through commercial dealings presented to him while travelling on the other track.

SUMMARY OF THE INVENTION

A board game constructed according to the teachings of the present invention includes a board having an endless track divided into blocks representing national American holidays and other common, traditional seasonal occurences, pursuits, and activities. The process of the game is to acquire as many of the blocks on the board as one can as one travels around the track. The object of the game is to win by forcing opponents to retire from the game by mortgaging all of the blocks they have acquired along with the depletion of all their money. The last remaining player is the winner. In addition to the game board, the game includes a supply of play money, a set of Destiny cards, a set of Ownership cards, a pair of standard dice, a single special AB die, a plurality of color coded player tokens, a plurality of sets of color coded property tile (or chip) markers, and a set of instructions.

Various features and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention to best defined by the appended claims.

BRIEF DESCRIPTION OF THE DRAWINGS

In the drawings wherein like reference numerals represent like parts:

FIG. 7 is a view of the front side of eight representative Destiny Cards shown in FIG. 2;

FIG. 8 is a view of the front and rear sides of six representative Ownership cards shown in FIG. 2; and FIG. 9 is a view of the front and rear sides of one of the property markers shown in FIG. 2.

DETAILED DESCRIPTION OF PREFERRED EMBODIMENT

Introduction

The components making up the game of this invention will first be described. The method of playing the game will then be described.

Components

Figure 1:
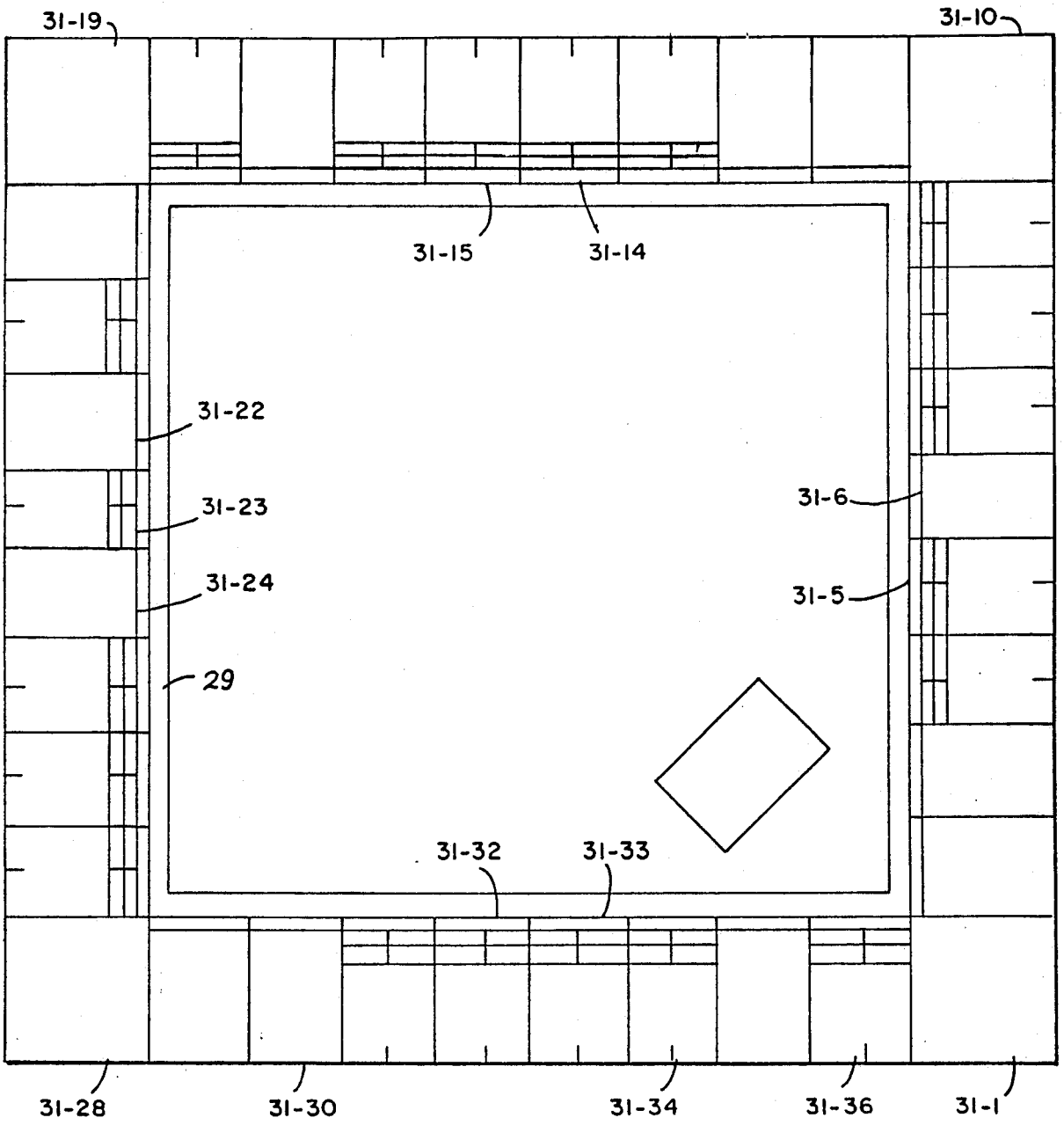
FIG. 1 is a plan view of the game board in the board game of this invention with the text inside each block removed.
Figure 2:
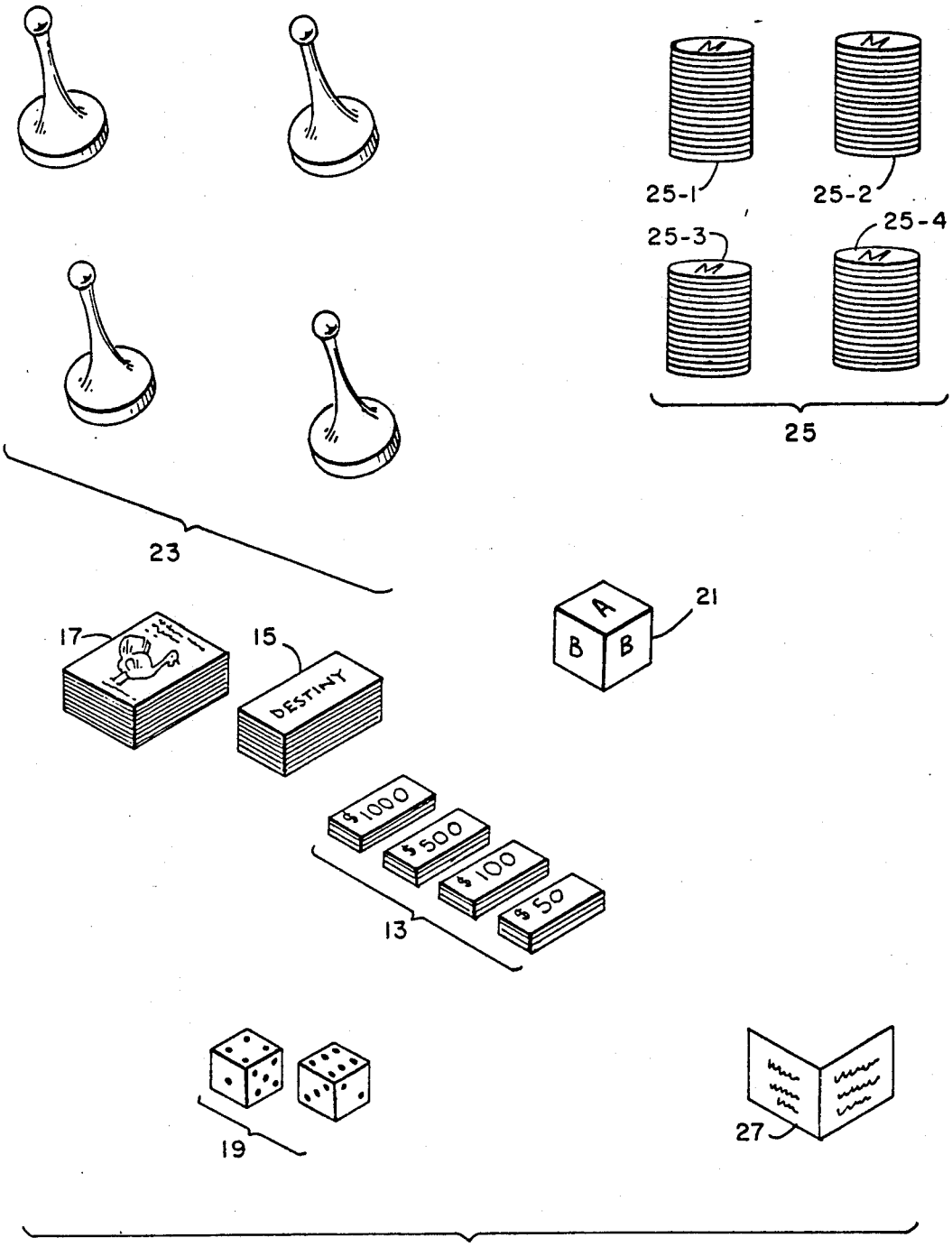
FIG. 2 is a perspective view of the other components of the board game of this invention.
Figure 3:
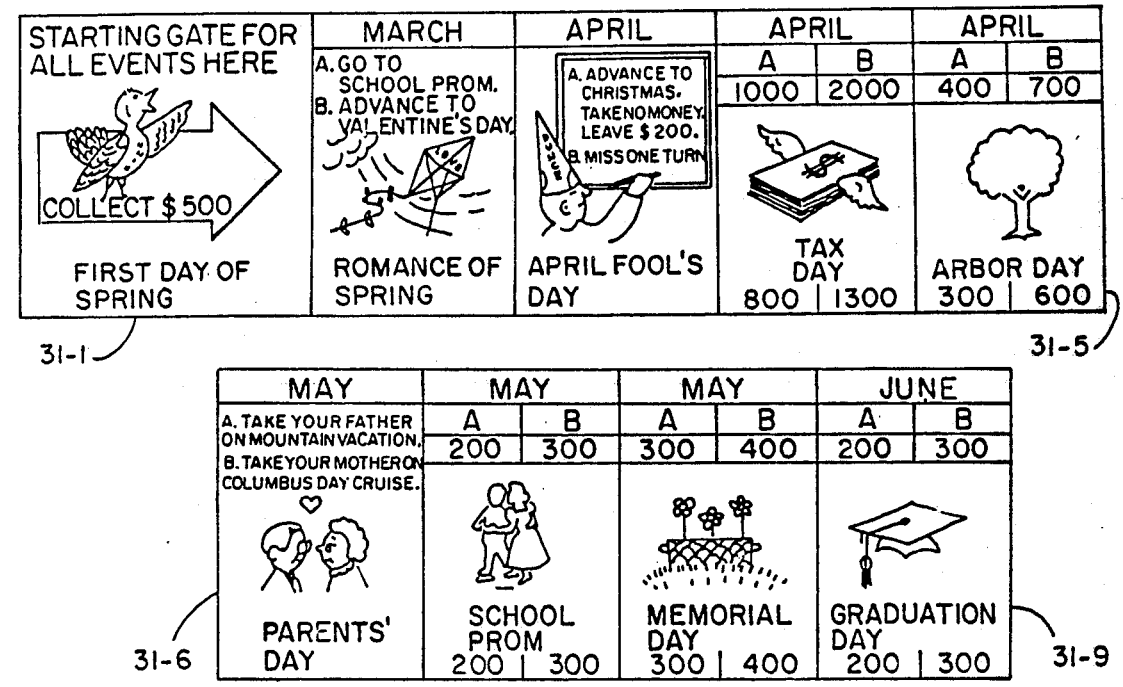
FIG. 3 is an enlarged view of the section of blocks 31-1 through 31-9 in the game board in FIG. 1.
Figure 4:
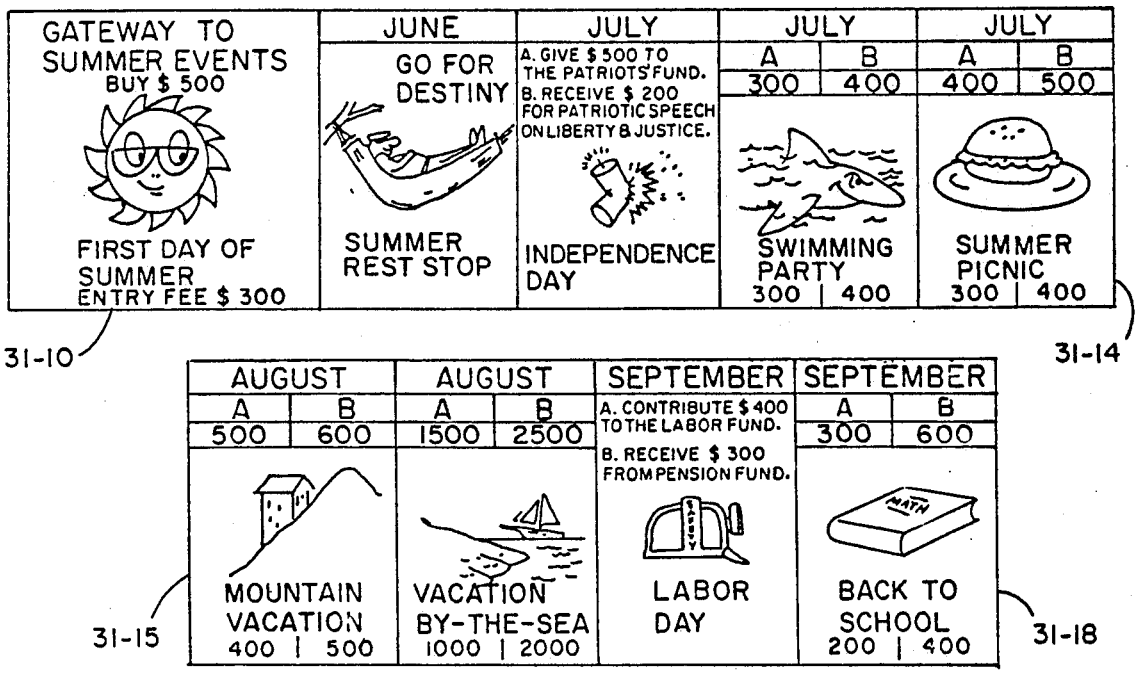
FIG. 4 is an enlarged view of the section of blocks 31-10 through 31-18 in the game board in FIG. 1.
Figure 5:
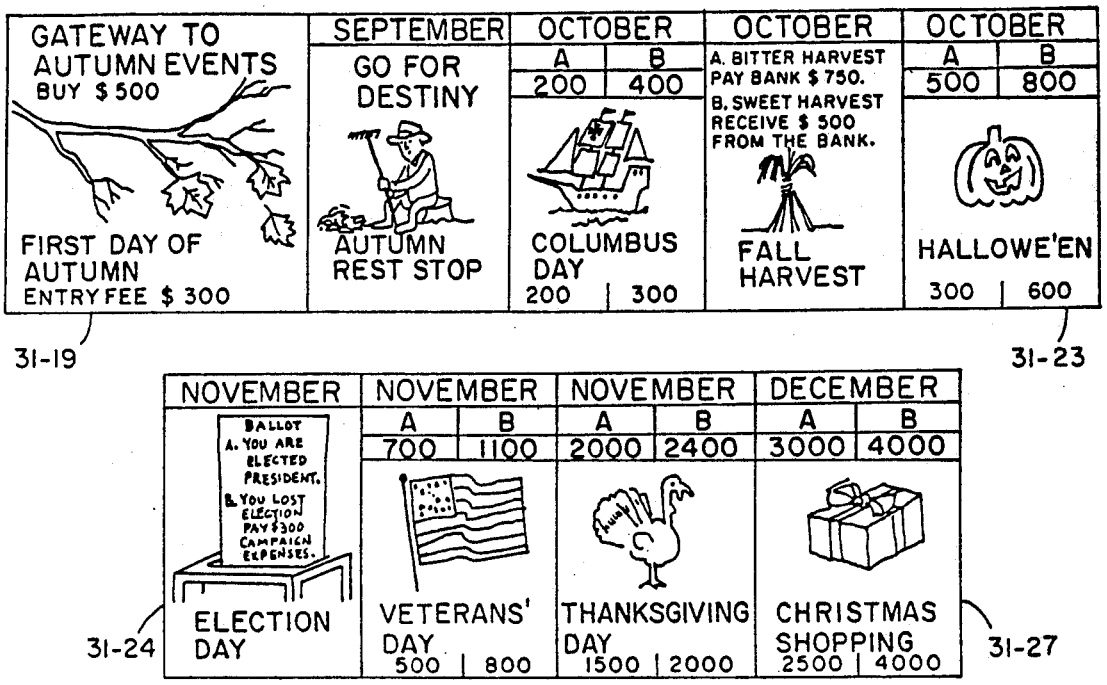
FIG. 5 is an enlarged view of the section of blocks 31-19 through 31-27 in the game board in FIG. 1.
Figure 6:
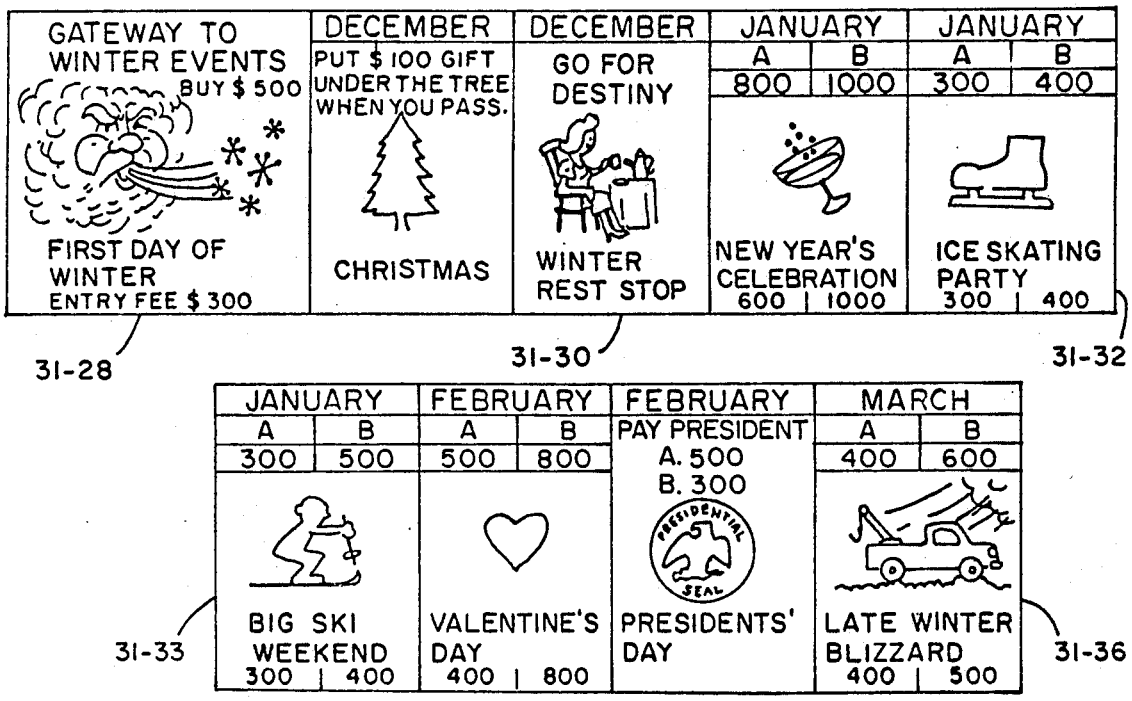
FIG. 6 is an enlarged view of the section of blocks 31-28 through 31-36 in the game board in FIG. 1.

The components making up the game are shown in FIGS. 1 and 2 and include a game board 11, a supply of play money 13, a set of destiny cards 15, a set of ownership cards 17, a pair of standard dice 19, a single special AB die 21, a plurality of color coded player tokens 23, a plurality of sets of color coded property markers 25 and a set of instructions 27.

The Game Board

Gameboard 11 is a twenty-two inch square. In the center of the game board 11 is a fifteen inch square open field in which dice can be cast in playing the game.

There is a three and one-half inch wide lined border along the periphery of board 11 with the innermost one-half inch 29 being enclosed in solid lines. Each of the four sides represents one of the four seasons which appear by name within border 29. The remaining three inch wide continuous peripheral pathway around board 11 is composed of thirty-six contiguous blocks 31-1 through 31-36 divided into four seasonal groups of nine blocks each containing holidays and activities common to each season.

The four seasons and their repective nine blocks in sequence of play as one travels around board 11 in a counterclockwise manner are:

A. Spring
31-1. First Day of Spring
31-2. Romance (or Rite) of Spring
31-3. April Fool's Day
31-4. Tax Day AB
31-5. Arbor Day AB
31-6. Parents' Day
31-7. School Prom AB
31-8. Memorial Day AB
31-9. Graduation Day AB
B. Summer
31-10. First Day of Summer
31-11. Summer Rest Stop
31-12. Independence Day
31-13. Swimming Party AB
31-14. Summer Picnic AB
31-15. Mountain Vacation AB
31-16. Vacation By-The-Sea AB
31-17. Labor Day 31-18. Back to School AB
C. Autumn
31-19. First Day of Autumn
31-20. Autumn Rest Stop
31-21. Columbus Day AB
31-22. Fall Harvest
31-23. Halloween AB
31-24. Election Day
31-25. Veterans' Day AB
31-26. Thanksgiving Day AB
31-27. Christmas Shopping AB
D. Winter
31-28. First Day of Winter
31-29. Christmas
31-30. Winter Rest Stop
31-31. New Year's Celebration AB
31-32. Ice Skating Party AB
31-33. Big Ski Weekend AB
31-34. Valentine's Day AB
31-35. Presidents' Day
31-36. Late Winter Blizzard AB All of the twenty blocks which contain the letters AB, in a horizontal row, such as blocks 31-4, 31-5 and 31-7 (see below for further identification of AB blocks) and the three blocks for the first days of Summer, Autumn and Winter may be purchased by the players. Blocks are purchased from the bank.

As can be seen in FIGS. 1 and 3-6 there are five blocks on each side of the board 11 with the letters AB disposed in a horizontal row at the top immediately under the name of the month (for example, blocks 31-4, 31-5 and 31-23), with letter A and letter B each enclosed within a separate rectangle. Directly under the letters AB are two different money (dollar) amounts which a player must pay the bank to acquire ownership of the A unit or the B unit of the block. At the bottom of each one of these blocks are two more money (dollar) numbers. These latter numbers represent the amounts of rent, fee, tariff, or payment owed the owner of a single tile (to be described below) for the A or B unit. For example, in block 31-27, a player's payment to the bank to buy a single tile for unit A is $3000 and for unit B is $4000. An opponent's payment to the owner of unit A with a single tile is $2500 and for a unit B with a single tile is $4000.

Descriptions of the A and B units for each box are listed on the Ownership cards to be described below that are given to the owner(s) when purchased.

The remaining thirteen blocks on board 11 cannot be owned by the players. Three of these other blocks i.e. blocks 31-11, 31-20 and 31-30 are "seasonal rest stops" that require the player to "Go for Destiny" meaning the player must pick a Destiny Card. There are also seven blocks with the letters A and B disposed vertically and with directions after each letter, such as blocks 31-2 and 31-12. Each time a player lands on one of these blocks, the player must then throw the AB Die 21 which decides what needs to be done next. For example, the instructions for Independence Day block 31-12 are:

A. Give $500 to The Patriots' Fund.

B. Receive $200 for Patriotic speech on liberty & justice.

If "A" comes up with a throw of the AB die, the player gives $500 to the bank (customer's fee to the Patriots' fund). If a "B" turns up, the player receives $200 from the bank.

This same rule governs the following A and B blocks. Clarifications will now be given to explain certain blocks more clearly.

ROMANCE (OR RITE) OF SPRING (Block 31-2). When first landing on this block the player must throw the AB die in order to determine whether to move the marker to the "School Prom" or to "Valentine's Day." When the player then moves the marker to either one, the player will need to cast the AB die for that block also.

APRIL FOOL'S DAY (Block 31-3). It should be kept in mind when the player advances to Christmas (assuming the player throws an "A" on the AB die) the player not only in this instance does not touch the money under the tree, but must place $200 under the tree when leaving that block the next turn. That is $100 more than the regular gift of $100 to be put under the tree.

The player "misses one turn" when "B" is thrown on the AB die.

PARENTS' DAY—Directions Clear.

LABOR DAY—Directions Clear.

FALL HARVEST—Directions Clear.

ELECTION DAY (Block 31-24) Upon landing on this block, if the player tosses "A" face up on the AB die, the player is elected president. The player leaves her/his marker on this block but is handed the "Presidential Card" either by the player handling the ownership cards or by the incumbent president if there is one. If the player throws a "B" face up on the AB die, the player pays the bank $300 for campaign expenses. The new president remains in office and will so until removed by another player.

Presidents' Day (Block 31-35) There is no need for the President to place a tile on this space. Flashing the "Presidential Card" shows who is the incumbent president entitled to either $300 or $500 when another player lands on this block. A throw of the AB die determines the amount to be given the president.

Other Non-owned Special Category Blocks

CHRISTMAS (Block 31-29) Player places $100 under the tree whenever they pass this block. If a player lands on this block and there is money under the tree the player takes it all but has to leave $100 there before he leaves on his next turn. A player can not pass this block and not leave his/her "gift" under the tree. The player must do this with his/her own money before receiving $500 from the bank for landing on or passing the first day of Spring.

FIRST DAY OF SPRING (block 31-1) This block will be explained in the section on "Playing the Game."

Destiny Cards 15

There are 32 Destiny Cards 15. As a pack, these cards are put face down in the designated place on the gameboard. The front side of eight representative Destiny cards 15 are shown in FIG. 7.

A player takes the top card in the pack of Destiny cards when:

1. He/She lands on a Seasonal Rest Stop that reads "Go for Destiny".

2. He/She throws a number ten (10) on the regular dice. Players must first follow the instructions on the card before moving their marker the ten (10) spaces indicated by the just thrown dice. When through with the card, it is returned to the bottom of the pack.

Note: A player could possibly end up picking two Destiny Cards during the course of one turn. For example, a player on throwing a ten (10) would pick a Destiny Card. Then after following the instructions on that card, the player could, with the full count of moving his/her marker ten (10) spaces, land on a Seasonal Rest Stop that would require a second Destiny Card. This would all depend on where the player is when the dice are thrown and on the kind of First Destiny Card picked.

Ownership Cards 17

There are forty-four Ownership cards 17 grouped together as follows:

1. There are forty cards, two for each block, for the twenty AB blocks. These cards are given to the players when they buy "A" and/or "B" units.

Except for the three Seasonal First Day cards and the Presidential card (respectively next described in 2 and 3), the players may among themselves agree to forego the distribution of the Ownership cards once they have become familar with them.

Color coded tiles placed on board 11 readily identify their AB block ownership.

The imagery on the Ownership cards provides a rich, imaginative supplement to the graphics on the board.

2. There are three cards, one each for the first day of Summer, Autumn and Winter. These are essential to distribute and hold onto.

3. Presidential card. There is one such card. It is given to the player who is elected president during the game. It is transferred among the players as they are elected President and as they remove one another from office.

The front and rear sides of six representative Ownership cards are shown in FIG. 8.

Regular Dice 19

There is a standard set of two dice.

Special Single AB Die 21

This die is a standard shaped cube with the letter A on three faces and the letter B on the remaining thre faces.

Color Coded Property Tile (or Chip) Markers 25

There are a set of four groups of the markers 25, each group 25-1, 25-2, 25-3 and 25-4 being a different color. As can be seen in FIG. 9 the front face of each tile is blank and the opposite face is stamped with the letter M (for mortgage). There are a total of 100 tiles, 25 of each color, enough for 4 players. These tiles are first placed on a property acquired with the M side face down. Later, when a mortgage is obtained the tile is turned M face up.

Color Coded Player Markers 23

There is a set of four color coded player markers 23, one for each player.

Paper Play Money 13

The play money comprises the following: $50, $100, $500, $1000 bills.

Playing the Game

After the gameboard has been opened on the table the Destiny Cards, the Standard Dice and the Special AB Die are placed on the Board. The 25 color-coded property tiles are distributed to each player at the beginning before the playing starts.

The players must choose someone to handle the Ownership cards. This player will give these cards to the players as they acquire holidays, businesses, and events.

The players also must decide to choose a second player to serve as the banker to handle the bank's money. The banker must take care, if he/she also participates as a player, to keep his/her money separate from the bank's funds.

The banker distributes $12,000 to each player as follows: Seven $1,000 Bills, seven $500 bills, ten $100 bills and ten $50 bills.

STARTING POINT: "THE FIRST DAY OF SPRING", block 31-1 is the starting gate for the game.

The players place their markers in "THE FIRST DAY OF SPRING" box 31-1. They then throw the standard dice to see who will go first. The player to his/her right will be next. The player markers are moved counter-clockwise in the direction of the pointing arrow from left to right. "THE FIRST DAY OF SPRING" block remains the property of the bank.

Except for the first throw, whenever a player lands on or passes the First Day of Spring, he collects $500 from the bank.

The first throw. The first count of the dice to move the marker begins at the "Romance of Spring" and not on "The First Day of Spring". For example a throw of two on the dice would land the marker on "April Fools' Day". This latter block requires the player to toss the AB die.

For each turn the standard dice are always thrown first, followed by a toss of the AB die most of the time but not all the time. This will be explained shortly.

If the throw of the standard dice results in any number but a ten (10), the player immediately moves the marker the full count of the dice. The player will then need to throw the AB die except when landing on any of the following:

1. Any rest stop
2. Any corner block. (Seasonal 1st days)
3. Christmas
4. Player's own wholly owned block.
5. Player's partly owned block where the other unit is not owned.

If the throw of the dice is a ten (10), the player must leave his marker where it is and must take the top Destiny Card and follow its instructions. After that the player then proceeds to move the marker the full count of ten.

Buying Properties, Businesses, etc

The general rule is that to buy any property or business a player must land on it, either by a throw of the dice, or being directed to advance there by a Destiny Card. The exception to this rule occurs toward the end of the game when players unmortgage other players' properties and are allowed to then purchase them directly from the owners. This arrangement will be explained later.

Also when buying properties players are given ownership cards.

Buying Holiday and Non-holiday Business Properties and Services of any AB block BH-1. Wholly unowned AB Block:

a. Whenever a player lands on such a block with a throw of the dice, either the A unit alone or both the A and B units together may be purchased from the bank. The purchase prices are listed under the letter A and B. After making payment to the bank the player places his color coded tiles(s) on the unit(s) just purchased. If the player decides to buy only one unit, he must purchase the A unit. A player is not permitted to bypass an A unit in order to pick up the more expensive and more desirable B unit. However, if the next player should land on that block, he may buy the B unit. It is always best to buy both units if the funds are available and if it fits in with the player's strategy. But, if the B unit in that block is still unowned, should the first player land on it again, he may buy it.

b. Whenever a player is directed by a Destiny Card to a block that turns out to have one or both the A and B units unowned, the player has the option to buy the B unit or the A unit. Not both. There are six Destiny Cards that carry this provision.

For example, card #17 is one of these cards and reads.

Advance to New Year's Celebration. If one or both units are already owned, throw the AB die. Pay half the charge. If one or both units are unowned, you may buy one unit at list.

With these cards, a player is able to "Bypass" an A unit and pick up a B unit directly.

A player may buy only one unit when he picks a Destiny Card that directs the player to a particular unit, to either unit A or to unit B. For example, card #16 says:

Advance to Christmas Shopping to unit B Jewelry Store. You may buy it, if unowned. If already owned, pay half the shopping charges.

If unit B is unowned, the player may in this instance buy it, if desiring to do so, even, if the A unit is also available. If unit A is unowned the player may not buy it as he was not directed to go there.

BH-2 Buying into a partly owned block where only either the A or B unit is already owned by another player:

When a player lands on such a block the player must throw the AB die to see first of all if he owes the owner any money.

If it is the A unit that is already owned and the player throws an "A" the player must pay the owner the amount of money listed on the margin. The player then may buy the unowned unit B if so desired or able to afford it. If the player had instead thrown a "B" he would owe nothing to the owner of unit A and could proceed directly to buy unit B.

If it is the B unit that is already owned the above rules would apply in reverse with the same throw of the AB die.

BH-3 Buying an unowned block of the First Day of Summer, Autumn or Winter.

For the corner blocks there is no need to throw the AB die. If unowned, any player on landing there may purchase a block at the listed buy price which is a standard $500 for each one.

When buying a seasonal "Gateway" corner block the player does not place a color coded tile on it. The player is given an ownership card to demonstrate his ownership of it.

There is no doubling up on corner blocks.

BH-4 DOUBLING UP by buying additional tiles.

The owner of property units has the option to double up on tiles, provided the owner has property tiles on three seasons or three sides of the board.

The doubling up must be done in an orderly way. The owner's A and B units in any given block must be doubled up first before doubling of any of the other blocks may begin.

In any given block, the A unit has to be doubled first, if the A and B units are not being doubled simultaneously. Also, the same player can not double up an A unit in another block until the B unit in the first block has been doubled.

The exception to this rule applies to blocks where two players have ownership, where one owns the A unit and where a second player owns a B unit.

The rent is doubled for units with 2 tiles.

Paying Rents, Fees, Service Charges.

PR-1. When a player lands on an AB block wholly owned by one or two other opponents, the amount owed and to which player will be determined by a throw of the AB die.

PR-2. When landing on an AB block that is partly owned by the player, and partly owned by an opponent, the player must still throw the AB die. If the player owns unit A and throws an "A" he owes the opponent nothing. But if a "B" is thrown the opponent collects the money amount listed on the margin. If the opponent has 2 tiles sitting on the B unit the player has to pay double the margin money.

PR-3. When landing on a partly owned AB block, rent is already covered earilier under section BH-2.

PR-4. When landing in any of the three owned seasonal gateways, a player pays the owner the listed entry fee of $300. If a player "bypasses" (that is does not land on any of the blocks during the course of play) He owes nothing to the owners.

PR-5. There is no rent paid on mortgaged properties.

Mortgaging Property and Businesses

A player may obtain a mortgage from the bank equivalent to one half the listed purchase price, no more no less. The amounts that may be borrowed are fully stated on the ownership cards, if there should be any question.

There is no set interest rate on the loan. Instead, there is a fixed $100 service fee for each tile mortgaged, regardless of the amount borrowed.

The Correct Order to Mortgage Titles

One half (one A and one B) of the tiles in all doubled units must be mortgaged first, block by block as needed. Then the single remaining tiles are mortgaged last, again block by block.

Property tiles are turned M face up to show their mortgaged status. Tiles may not be mortgaged to raise money to buy other properties. Mortgages are obtained only to raise money to pay off debts or obligations.

The first days of summer, autumn, and winter may not be mortgaged.

While mortgaged a player may not buy additional property. A player may resume buying when all his properties have been unmortgaged.

Unmortgaging

To pay off a mortgage an owner simply returns to the bank the amount borrowed plus a $100 service fee for each tile. The owner then turns all unmortgaged tiles: M face down.

The Correct Order to Unmortgage Tiles

As with morgaging, unmortgaging must be done in an orderly way, block by block. First, a player must unmortgage one A and one B tile in all doubled units, block by block. Then the remaining single A and B tiles may begin to be unmortgaged, block by block.

Winning and Concluding the Game

As the players are successively forced to take on mortgages, the game can be said to have entered the winding down phase though the game could go on for quite a while before it ends.

Players are forced to retire from the game when all their properties are mortgaged and all their money has been effectively depleted. As each player "retires" from the game, he retires all his property tiles from the board.

But before doing that, any player who still has unused color coded tiles left to make a switch with the potential or impending "retire's" tiles and to whom the latter owes money has the first right to offer to buy any of that player's properties by first paying off the mortgage and the $100 service fee on each tile to the bank.

Thus unencumbered with debt, these properties are put up for sale. The owner of the unmortgaged properties acts as his own sales agent. Bidding on these unmortgaged properties is set at one half the listed purchase price. If two players offer to buy any given property at half listed price, then the owner may give it to whichever he wishes.

With this infusion of new money a player may be able to pay off some of his other mortgages and try for a comeback in the game.

The game ends when all but one player is left as the winner.

The game can also end in a draw if the players "tire" of trying to retire one another. The players simply have to agree to a draw to conclude the game. If there is no agreement by any one player the game can not be considered a draw; the game will have to go on until one player succeeds in retiring his opponents.

A player may concede the game to an opponent if the game seems to be hopelessly in favor of the opponent.

At any time in the course of play, the contestants may agree to terminate the game and add up all their business and property values and cash. The player with the greatest assets wins.

I claim:

1. A board game comprising:

a. a game board having an endless path of contiguous blocks, some of the blocks representing property which is purchasable and a plurality of the blocks each displaying two alternative directions, b. a plurality of destiny cards, each card describing an event, c. a plurality of ownership cards, each card describing commercial transactions for a different piece of property, d. a device operable by the players for determining randomly between said two directions, e. a plurality of tokens, one for each player, f. a plurality of property markers for identifying ownership of property, and g. means for determining a numerical value.

2. A board game according to claim 1 and wherein the means for determining a numerical value comprises a plurality of numerically marked dice.

3. A board game according to claim 2 and wherein each property marker comprises a piece having two surfaces, each surface being marked differently from the other and each property marker adapted to be placed on one of said blocks to indicate the ownership of that block.

4. A board game according to claim 3 and wherein the device comprises a single die.

5. A board game according to claim 4 and wherein each block represents a holiday, seasonal occurence, pursuit or activity.

6. A board game according to claim 5 and wherein said single die has each of its faces marked with one of the letters A and B corresponding to said two alternative directions.

* * * * *